United States Patent [19]

Wen-Jen et al.

[11] 4,425,668

[45] Jan. 17, 1984

[54] THUMBLESS BOXING GLOVES

[76] Inventors: Ko Wen-Jen, No. 27 Shin Shen Rd. Chao Chou, Pingtung, Taiwan; Ko Wen-hsiung, No. 735 Kupulau St., Hilo, Hi. 96720

[21] Appl. No.: 336,040

[22] Filed: Dec. 31, 1981

[51] Int. Cl.[3] ..... A41D 13/08

[52] U.S. Cl. ..... 2/18

[58] Field of Search ..... 2/18, 161 A, 19, 16, 2/20

[56] References Cited

U.S. PATENT DOCUMENTS 2,556,759 6/1951 Hilton ..... 2/18

3,540,059 11/1970 Kennedy ..... 2/18

*Primary Examiner*—Doris L. Troutman

*Attorney, Agent, or Firm*—Holman & Stern

[57] ABSTRACT

This invention is called "Thumbless boxing gloves". This boxing glove is so made as to hide properly the thumb in order that it cannot be stretched out during the action of fighting, and injure the opponent incidentally.

Padded with sponge rubber inside, this glove is covered with an outer leather, inside which there is an inner cover of such a shape that the thumb will not easily be moved forward to give an accidental wound to the opponent. Two lines of holes on both sides along the gap cut in the middle part below the palm a ribbon band to be fastened crisscross to bind the glove around the arm. This newly-designed glove can comply with the new regulation of the Boxing Association that the thumb should be hidden properly.

1 Claim, 4 Drawing Figures

THUMBLESS BOXING GLOVES

BACKGROUND OF THE INVENTION

In spite of the fact that boxing is quite a violent and dangerous sport, not a few people like to devote themselves to it because its game always abounds in thrills and tensions to the audience. Besides, the first rate boxer who could win a game to be a champion could obtain not only a publicity but also a wealth.

But it is a great regret that boxers sometimes get wounded by traditional boxing gloves which have the shape of two parts for the fist, that is, one hiding the thumb and the other for the other four fingers.

So the part hiding the thumb is liable to be unexpectedly stretched forward and give accidental wounds to the opponent during a game. In light of this drawback of the traditional gloves, the World Association of Boxing has made a new special regulation that boxers shall not use such a glove that has a separate section for the thumb only, liable to give wounds to boxers. In other words, gloves should be so shaped that the thumb and the other four fingers will be hidden in one section, otherwise they will be deemed as unsatisfactory to the rules.

Having engaged in the export of boxing gloves, the designers have worked out this new glove according to years' experiences and the principles of the physical technology.

BRIEF DESCRIPTION OF DRAWINGS

For the purpose that this invention may be clearly understood, an embodiment thereof will now be described by way of example with reference to the accompanying drawings in which.

DESCRIPTION OF THE PREFERRED EMBODIMENT

Figure 1:
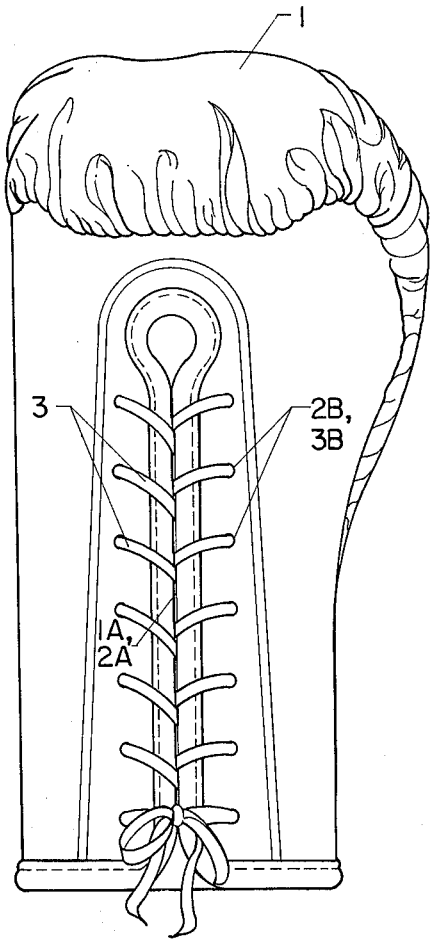
FIG. 1 is the front view of this glove.
Figure 2:
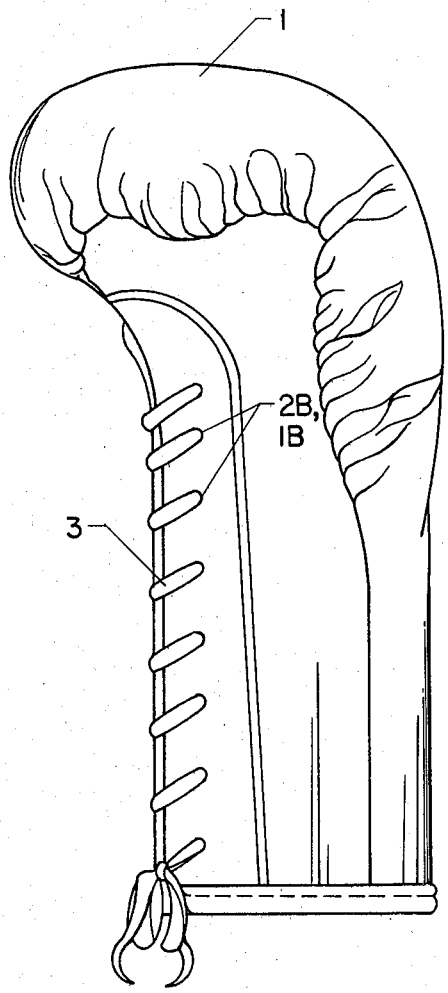
FIG. 2 is the whole view of this glove.
Figure 3:
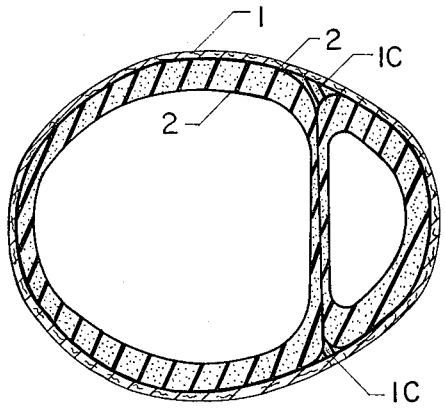
FIG. 3 is the A—A cross section of this glove.
Figure 4:
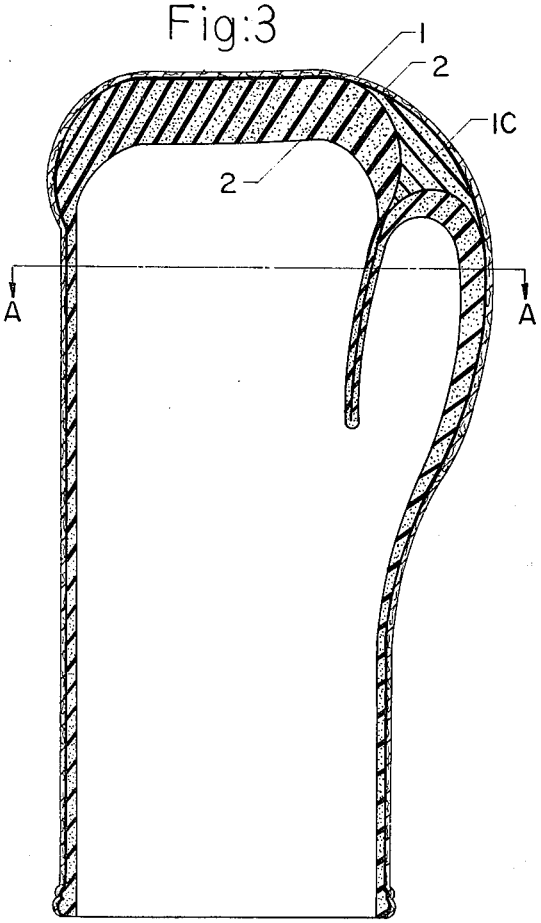
FIG. 4 is the front cross section view of this glove.

This glove consists of an outer leather cover (1), an inner leather cover (2) and a ribbon (3). A thick layer of sponge rubber is padded with the inner cover (2) in which is left empty space for the thumb and the other four fingers, the palm, the wrist and the arm. The empty space in the top of the inner cover is properly parted in accordance with the shape and structure of a human hand.

The thickness of sponge rubber is made according to the regulation of the Boxing Association. Besides, its softness is also made particularly in accordance with the boxing game rules. In the part hiding the arm is cut a gap (2A) in the middle of the inner side, and along the both sides of the gap (2A) are punched several holes (2B) through which a ribbon (3) can be inserted crisscross for fastening the glove to needed tightness. In other words, the width of the gap (2A) can be adjusted by means of the ribbon (3) for the purpose of wearing and removing the glove.

The outer leather cover (1) is made up of soft leather and a little larger than the inner leather cover (2), The part of the outer cover (1) holding the fingers should match tightly with the outer part of the inner cover, so that they will be formed as a fist when a boxer inserts his hand in the glove. Then the hitting force of the boxer's hand can be transmitted from inside to outside to the best. Nevertheless, the thumb can not be stretched out to give an accidental wound to the opponent.

When the inner cover (2) is fitted into the outer cover (1), both covers should coincide each other precisely in every part. The gap (1A) of the outer cover (1) is to coincide with the gap (2A) of the inner cover (2), and so are ribbon holes (1B) in the outer cover (1), so that the ribbon (3) may be inserted through the holes (1B,2B) to tighten or relax the gap (1A,2A) for wearing or removing the glove.

A supplementary layer of sponge rubber (1C) is to be added on the part between the thumb and the other fingers, after the inner cover (2) is fixed into the outer cover (1). The purpose of this layer is to fill up the empty space between the thumb and other four fingers, to make the fist part round up so as to give hitting action smoothness.

What is claimed is

1. A thumbless boxing glove consisting of an outer leather cover, an inner leather cover and a ribbon: the inner leather cover, padded with sponge rubber of suitable thickness and softness, having a section for the thumb, a section for the other four fingers, and a section for the wrist and the arm, formed according to the fist and arm shape; the outer cover almost shaped the same as the inner cover, carrying a supplementary layer of sponge on between the sections of the inner cover for the thumb and the other four fingers; a ribbon being inserted through the holes on both sides of a gap cut in the middle part below the palm, in order to tighten or relax the gap for wearing or removing.

* * * * *